US005893788A

United States Patent [19]

Makita et al.

[11] Patent Number: 5,893,788

[45] Date of Patent: Apr. 13, 1999

[54] SUPPORT ALIGNING FIXTURE

[75] Inventors: Yoshio Makita; Satoshi Yoshimura; Shigeo Itoh, all of Mobara, Japan

[73] Assignee: Futaba Denshi Kogyo K.K., Mobara, Japan

[21] Appl. No.: 08/856,998

[22] Filed: May 15, 1997

[30] Foreign Application Priority Data

May 27, 1996 [JP] Japan ..... 8-152942

[51] Int. Cl.[6] ..... H01J 9/26

[52] U.S. Cl. ..... 445/63

[58] Field of Search ..... 445/63

*Primary Examiner*—Kenneth J. Ramsey
*Assistant Examiner*—Gene H. Rhodes
*Attorney, Agent, or Firm*—Oblon, Spivak, McClelland, Maier & Neustadt, P.C.

[57] ABSTRACT

A support aligning fixture capable of facilitating fitting of supports in support holes of an aligning plate and improving positional accuracy of the supports. First and second aligning plate members of the same construction and thickness are superposed on each other while being registered with each other, to thereby provide an aligning plate. The aligning plate members each are formed with tapered support holes, to thereby facilitating insertion of supports therein. The supports are positioned by two diameter-reduced ends of the support holes of the aligning plate members, resulting in positional accuracy of the supports being increased.

5 Claims, 8 Drawing Sheets

SUPPORT ALIGNING FIXTURE

BACKGROUND OF THE INVENTION

This invention relates to a support aligning fixture, and more particularly to a fixture for aligning supports incorporated in a vacuum glass envelope which is formed by joining two glass substrates to each other and evacuated to a vacuum.

In general, a fluorescent display device includes a vacuum envelope in which an electron emission source for emitting electrons in a vacuum atmosphere and a luminous element such as a phosphor excited by the emitted electrons for luminescence are arranged. The vacuum envelope is typically made of glass into a vacuum or sealed structure. More specifically, the vacuum envelope is constructed of a first glass substrate and a second glass substrate arranged in a manner to be spaced at a microinterval from the first glass substrate while being opposite thereto and is provided therein with phosphors for providing a flat display plane and an electron emission source for emitting electrons for luminescence of the phosphors. The envelope thus constructed is then evacuated to a vacuum. Thus, in order to keep the first and second substrates spaced from each other at a predetermined interval irrespective of such evacuation of the envelope to a vacuum, it is typically executed to arrange supports in the form of a pin between the first substrate and the second substrate.

Now, such arrangement will be described hereinafter with reference to FIGS. 6 and 7.

A number of supports 101 in the form of a pin are interposedly arranged between a first substrate 102 and a second substrate 103, although only three such supports are shown in FIGS. 6 and 7 for the sake of brevity. The supports 101 each are typically made of glass fiber into dimensions as small as, for example, about 50 μm in diameter and 200 μm in length.

Such microscopic or microsized supports 101 cause arrangement of the supports 101 between the first substrate 102 and the second substrate 103 by manual operation to be highly difficult or substantially impossible. Thus, a support aligning plate 100 formed with a number of support holes 114 for arranging the supports 101 at predetermined positions on the substrates is used as a fixture for the arrangement as shown in FIG. 6.

More particularly, the supports 101 each are fittedly arranged at a proximal or lower end thereof in each of the support holes 114 of the aligning plate 100 acting as the fixture. The aligning plate 100 is provided on a lower surface thereof with a perforated section 112, through which air is drawn out to raise the supports 101 in the support holes 114. Then, the supports 101 thus raised each are provided on a distal or upper end thereof with a paste 121 for adhesion by transfer printing, through which the supports 101 are adhered or bonded to the first substrate 102 as shown in FIG. 7, resulting in being securely mounted on the first substrate 102.

The description will be further made with reference to FIGS. 8(*a*) to 8(*c*). First, a glass fiber material of about 50 μm in diameter for the supports 101 is cut into a length of about 200 μm, to thereby provide the supports 101. The supports 101 thus cut each are cleaned and then positioned with respect to the first substrate 102 by means of a fixture 110. The fixture 101 is formed into a box-like shape as shown in FIGS. 8(*a*) to 8(*c*) and includes an aligning plate 111 formed with support holes 114 for raising the supports 101 therein, a perforated section 112 made of a perforated material and arranged under the aligning plate 111, and an evacuation section 113 through which an interior of the fixture 110 is evacuated.

Positions on the aligning plate 111 at which the support holes 114 are formed are determined so as to correspond to positions on the first substrate 102 on which the supports 101 are arranged.

In the fixture 110 thus constructed, the evacuation section 113 is connected to a vacuum pump (not shown). Then, the supports 101 are spread over the aligning plate 111 of the fixture 110 while evacuating the interior of the fixture 110, so that air drawn out through the support holes 114 is permitted to pass through the evacuation section 113. This results in the supports 101 being introduced into the support holes 114 formed into a diameter larger than that of the supports 101, to thereby be raised in the support holes by suction as shown in FIG. 8(*a*).

Then, a glass plate 120 to which a paste 121 to be transferred is applied is positioned above the fixture 110 as shown in FIG. 8(*b*) and then contacted with the supports 101, resulting in the paste 121 being transferred from the glass plate 120 to an upper end surface of the supports 101 held on the fixture 110, as shown in FIG. 8(*c*).

Subsequently, as shown in FIG. 8(*c*), the first substrate 102 is put on the fixture 110 on which the supports 101 having the paste 121 transferred thereto are held while being aligned with the fixture 110, so that the supports 101 are adhered at one end surface thereof to the first substrate 102. Thus, adhesive force of the paste 121 permits the supports 101 to be transferred to the substrate 102.

The paste 121 mainly consists of seal glass of a low softening point having lead oxide contained therein in order to permit the paste 121 to have a coefficient of thermal expansion approaching to that of the first substrate 102 made of glass. The paste 121 may be mixed with a solvent or the like, to thereby be provided with stickiness, as required. Then, the second substrate 103 is arranged opposite to the first substrate 102 which is mounted thereon with the supports 101 by welding in a manner to be spaced from each other at predetermined intervals, to thereby form a glass envelope. The envelope thus provided is then evacuated to a vacuum, so that a vacuum glass envelope in which the supports 101 are pressedly interposed between the first substrate 102 and the second substrate 103 to which an atmospheric pressure is applied is provided. A space between the first substrate 102 and the second substrate 103 is sealedly closed at a periphery thereof with a seal material (not shown).

Also, the conventional envelope may be so constructed that the paste is deposited on the other or lower end surface of the supports 101 as well by transfer printing. Then, the first and second substrates 102 and 103 are aligned with each other and then heated in a sealing oven. This permits the transferred paste to be melted, to thereby bond the other end surface of the supports 101 to the second substrate 103 through the paste, resulting in the vacuum glass envelope being provided wherein the supports 101 are fixed at both ends thereof to the substrates 102 and 103. The supports 101 may be arranged in a manner to be spaced from each other at intervals of about 2 to 5 mm.

Fitting of the supports 101 in the support holes 114 of the aligning plate 111 thus carried out is shown in FIG. 9. The conventional envelope, as shown in FIG. 9, causes the supports 101 to be arranged in the support holes 114 while being inclined with respect to the support holes 114, resulting in misregistration often occurring therebetween. This is due to a gap of an excessive size defined between the support 101 and the support hole 114 in which the support 101 is fitted. More particularly, the support holes 114 each are generally formed into a diameter of about 53 μm so as to define a gap of a slight size between the support 101 and the support hole 114 in order to prevent hang-up of the support 101 in the support hole 114 due to friction therebetween. The support 101 is generally formed so as to have a tolerance of ±3 μm, whereas the support hole 114 has a tolerance of +5/−0 μm, so that an excessive gap is often undesirably defined between the hole 101 and the support hole 114.

Also, in order that the aligning plate 111 formed with the support holes 114 is prepared with increased accuracy, it is required to restrict a thickness of the aligning plate 111 to a level less than about 70 μm. Unfortunately, this causes the supports 101 to be projected by a distance as large as about 130 μm from the aligning plate 11, resulting in the supports 101 being rendered unstable.

This results in the amount of displacement δ of a center of the support 101 from a center of the support hole 114 being increased to about 20 μm or less. Unfortunately, such displacement of the support 101 as large as about 20 μm in an envelope for a fluorescent display device in which picture cells are arranged in a manner to be spaced at pitches of 360 μm and intervals of 80 μm from each other may possibly cause troubles such as deterioration in display of a display section by the supports 101, short-circuiting of internal electrical wirings and the like.

The reason why the conventional envelope fails to increase a thickness of the aligning plate 111 to about 70 μm or more is due to preparation of the aligning plate 111. Now, the manner of manufacturing of the conventional envelope 11 will be described with reference to FIGS. 10(*a*) to 10(*d*). First, as shown in FIG. 10(*a*), a photoresist 132 is coated on a stainless steel plate 131. Then, a glass photographic plate 133 having a mask 134 formed on one surface thereof is arranged on the photoresist 132, followed by irradiation of light onto the photographic plate 133, to thereby expose the photoresist 132 to light, as shown in FIG. 10(*b*) Then, the photoresist 132 is subject to development, so that only photoresists 135 exposed to light remain on the stainless steel plate 131 as shown in FIG. 10(*c*). A number of such photoresists 135 are formed on the stainless steel plate 131 while being aligned with positions on which the supports 101 are raisedly arranged.

Then, the stainless steel plate 131 is subject to electroplating using nickel (Ni) as a material to be electroplated, so that a nickel plate 136 may be formed on only the stainless steel plate 131 as shown in FIG. 10(*d*).

Then, the photoresists 135 are removed, so that regions on the stainless steel plate 131 occupied by the photoresists 135 may permit the nickel plate 136 to be formed with apertures each acting as the support hole 114. Then, the nickel plate 136 is removed from the stainless steel plate 131, resulting in providing the aligning plate 111 formed with a number of the support holes 114.

An increase in thickness of the aligning plate 111 may be attained by increasing a thickness of the photoresist 132 coated on the stainless steel plate 131. Unfortunately, an increase in thickness of the photoresist 132 causes a degree to which light irradiated for exposure is scattered in the photoresist 132 to be increased, leading to a deterioration in accuracy of patterning of the photoresist 132. More specifically, the photoresist 135, as shown in FIG. 10(*c*), is exposed to light in a manner like a trapezoid in section due to scattering of light irradiated. Thus, an increase in thickness of the aligning plate 111 causes the support holes 114 to be formed while being tapered, leading to a deterioration in accuracy of dimensions thereof.

Such a deterioration in accuracy of dimensions of the support holes 114 and such formation of the tapered support holes 114 in the aligning plate 111 render a diameter of an upper portion of the support holes 114 different from that of a lower portion thereof, so that displacement of the support 101 fitted in each of the support holes 114 from a center of the support hole 114 is further increased as will be noted from FIG. 9. This results in the conventional vacuum glass envelope being unsuitable for a fluorescent display device.

Thus, it will be noted that a thickness of the aligning plate 111 is limited to less than about 70 μm.

In order to solve the problem, the assignee proposed a support aligning fixture constructed as shown in FIG. 11. The support aligning fixture proposed is constructed into a two-layer structure and includes an aligning plate constructed of a first aligning plate member 150 formed into a thickness of about 30 μm and provided with support holes with increased accuracy and a second aligning plate member 151 formed into a thickness of about 90 μm and provided with support holes. The support holes of the second aligning plate member 151 may be formed with reduced accuracy as compared with those of the first aligning plate member 150. The support holes of the second aligning plate member 151 are formed into a diameter larger than that of a diameter of supports 101. Positioning of the supports 101 is carried out by means of the support holes of the first aligning plate member 150. The support aligning fixture thus constructed permits the supports 101 to be supported at a high position in the support hole of the first aligning plate member 150. Also, it improves positional accuracy of the supports 101 or accuracy with which the supports 101 are positioned in the support holes, because the support holes of the first aligning plate member 150 are formed with increased accuracy.

Nevertheless, the support aligning plate shown in FIG. 11 has a disadvantage that operation of fitting the supports 101 in the fixture is rendered difficult or troublesome. More particularly, the tapered support holes 114 formed through the aligning plate 111 shown in FIG. 9 are formed at an upper portion thereof into a diameter of about 60 μm and the supports 101 are formed into an average diameter of about 50 μm, so that a gap as large as about 10 μm may be defined between each of the supports 101 and each of the support holes 114, which is sufficient to facilitate the support filling operation. On the contrary, in the aligning plate of the two-layer structure shown in FIG. 11, the supports 114 are formed at an upper portion thereof into a diameter of 53+3/−0 μm and the supports 101 are formed into an average diameter of about 50 μm, so that a gap therebetween is as small as about 3 to 6 μm.

Also, the fixture shown in FIG. 11 is adapted to be applied to supports of 150 to 300 μm in length. More particularly, a fluorescent display device wherein an anode voltage is set to be about 200 to 600 V is so constructed that intervals between gates and anodes are set to be 150 to 300 μm so as to permit the device to withstand the anode voltage.

In general, luminous efficiency of a phosphor is enhanced with an increase in anode voltage. An increase in anode voltage requires to increase intervals between the gates and the anodes to withstand the anode voltage. For example, setting of the anode voltage at 1000 V requires to increase intervals between the gates and the anodes to 500 μm or more.

Unfortunately, in the fixture of FIG. 11 including the aligning plate of the aligning plate members 150 and 151, the aligning plate has a thickness limited to about 70 μm or less in order to improve accuracy with which the support holes are formed. Thus, the prior art fails to permit the supports of 500 μm in length to be arranged with increased positional accuracy.

SUMMARY OF THE INVENTION

The present invention has been made in view of the foregoing disadvantage of the prior art.

Accordingly, it is an object of the present invention to provide a support aligning fixture which is capable of facilitating arrangement of supports in support holes.

It is another object of the present invention to provide a support aligning fixture which is capable of enhancing positional accuracy of supports in support holes even when the supports are formed into an increased length relative to a diameter thereof.

In accordance with the present invention, a support aligning fixture is provided which is directed to a vacuum glass envelope at least including two glass substrates arranged opposite to each other and functions to hold supports between the glass substrates of the vacuum glass envelope to keep the glass substrates spaced from each other at a predetermined microinterval. The support aligning fixture includes at least two aligning plate members like a thin plate each formed with a plurality of support holes in which the supports are raisedly arranged. At least upper and lower ones of the aligning plate members are formed into the same thickness and superposed on each other while being registered with each other to provide an aligning plate.

In a preferred embodiment of the present invention, the support holes each are formed into a tapered shape in section and the aligning plate members for the aligning plate are superposed on each other in such a manner that surfaces of the aligning plate members on which the support holes are increased in diameter face each other.

In a preferred embodiment of the present invention, the support holes of at least one intermediate one of the aligning plate members are formed into a larger diameter than those of the upper and lower ones of the aligning plate members.

Also, in accordance with the present invention, a support aligning fixture is provided which is directed to a vacuum glass envelope at least including two glass substrates arranged opposite to each other and functions to hold supports between the two glass substrates of the vacuum glass envelope to keep the glass substrates spaced from each other at a predetermined microinterval. The support aligning fixture includes two first aligning plate members like a thin plate each formed with a plurality of support holes in which the supports are raisedly arranged. The first aligning plate members are formed into the same thickness and superposed on each other while being registered with each other. The support aligning fixture also includes at least one second aligning plate member formed into a thickness different from the first aligning plate members and provided with a plurality of support holes. The second aligning plate member is interposedly arranged between the first aligning plate members while being registered with the first aligning plate members. The first and second aligning plate members cooperate with each other to provide an aligning plate. The support holes of the second aligning plate member are formed into a diameter larger than those of the first aligning plate members.

In a preferred embodiment of the present invention, the support holes each are formed into a tapered shape in section. The first and second aligning plate members are superposed on each other in turn in such a manner that surfaces of the first aligning plate members on which the support holes thereof are increased in diameter face up and a surface of the second aligning plate member on which the support holes thereof are increased in diameter faces down.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
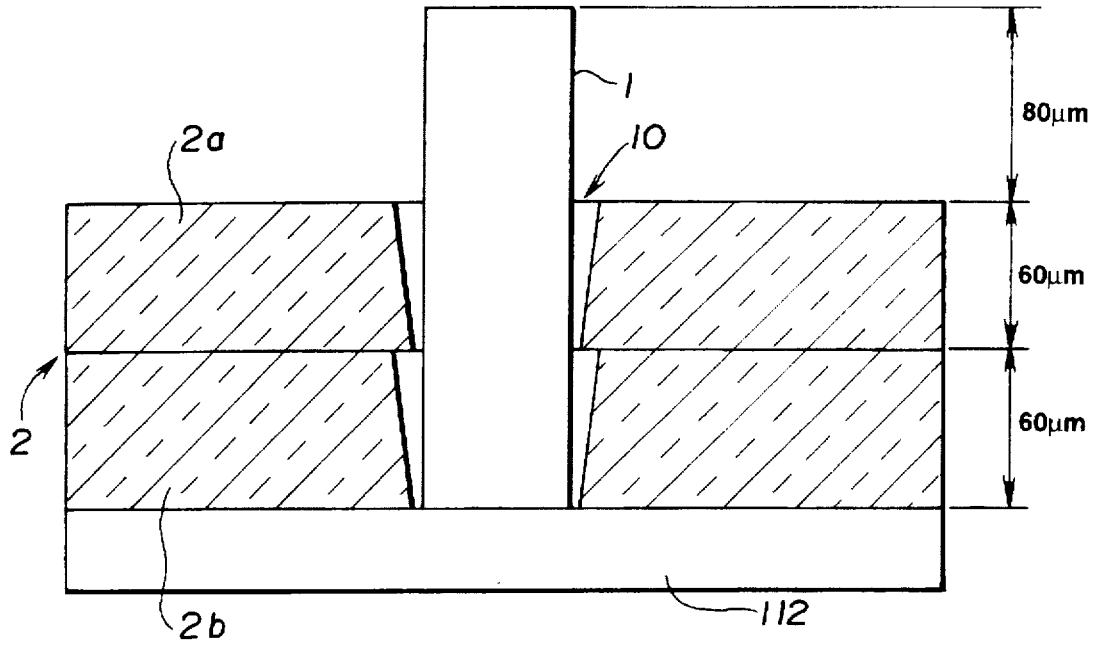
FIG. 1 is a schematic view showing an aligning plate incorporated in an embodiment of a support aligning fixture according to the present invention.

Now, a support aligning fixture according to the present invention will be described hereinafter with reference to FIGS. 1 to 5, wherein like reference numerals designate like or corresponding parts throughout.

Figure 7:
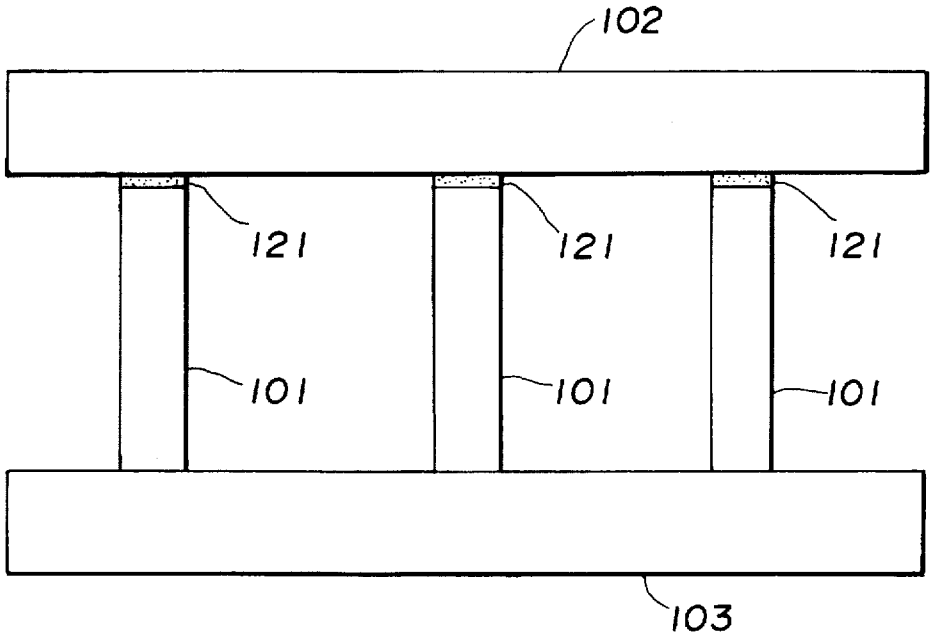
FIG.7 PRIOR ART
FIG. 7 is a schematic view showing a manner of mounting of supports in a vacuum glass envelope in a prior art.
Figure 8A:
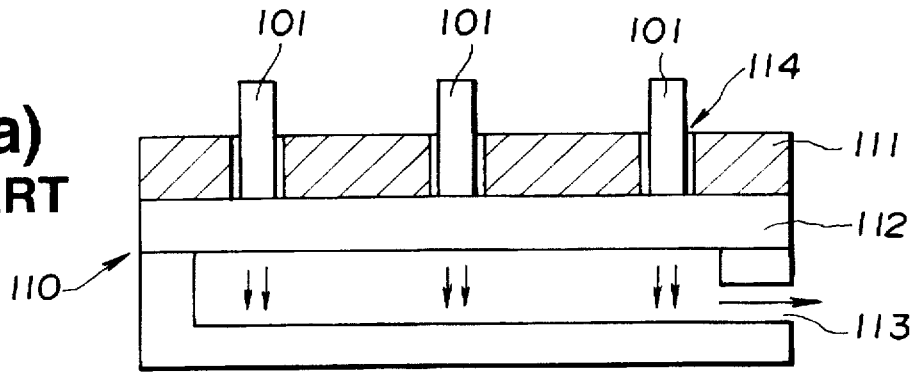
FIG.8(a) PRIOR ART
FIGS. 8(*a*) to 8(*c*) each are a schematic view showing each of steps in arrangement of supports by means of a conventional support aligning fixture.
Figure 8A:
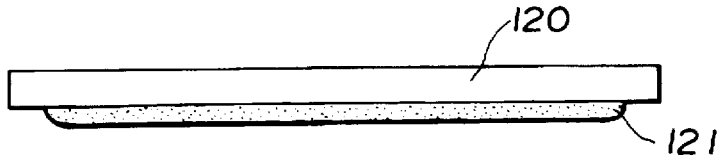
FIG.8(a) PRIOR ART
Figure 8B:
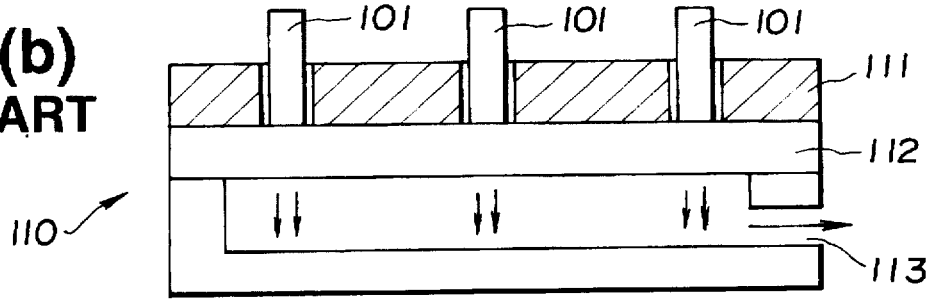
FIG.8(b) PRIOR ART
Figure 8C:
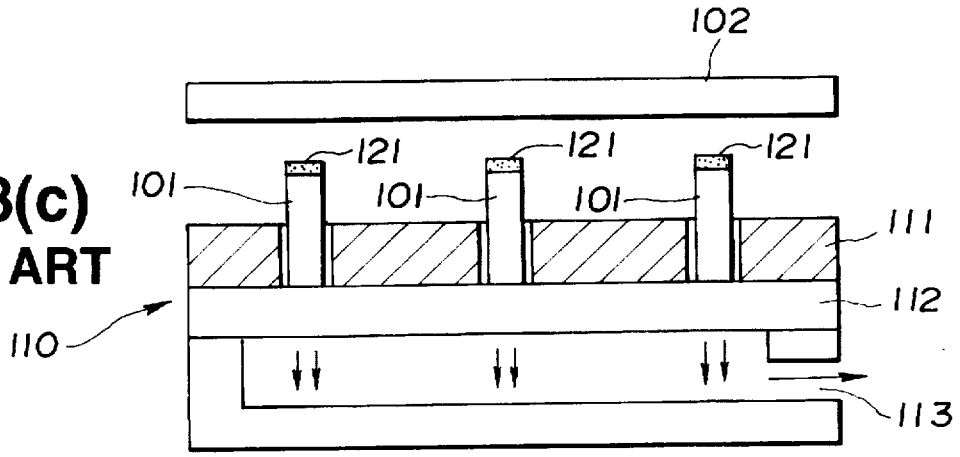
FIG.8(c) PRIOR ART
Figure 9:
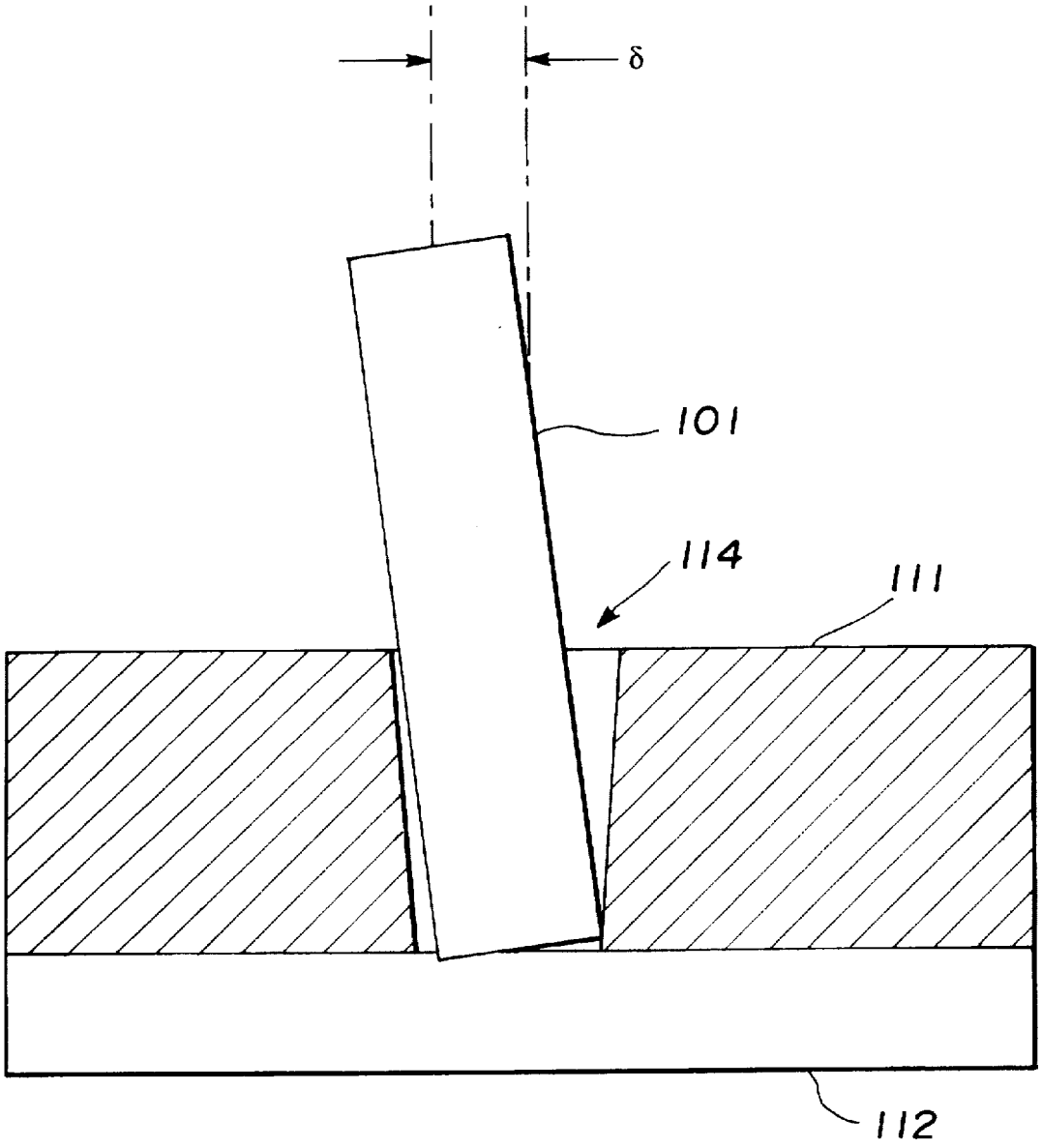
FIG.9 PRIOR ART
FIG. 9 is a schematic view showing displacement of a support in a prior art.
Figure 10A:
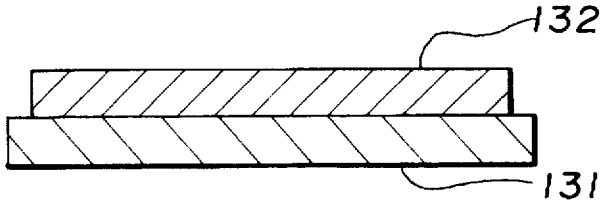
FIG.10(a) PRIOR ART
FIGS. 10(*a*) to 10(*d*) each are a schematic view showing each of steps in manufacturing of a conventional aligning plate.
Figure 10B:
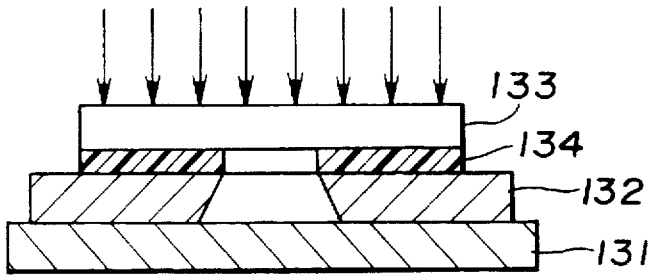
FIG.10(b) PRIOR ART
Figure 10C:
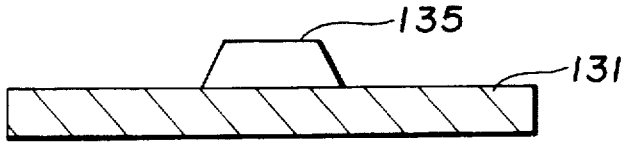
FIG.10(c) PRIOR ART
Figure 10D:
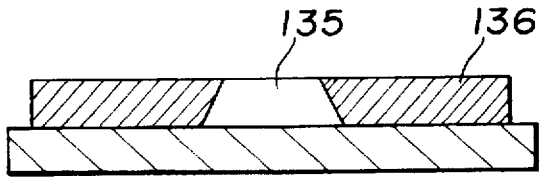
FIG.10(d) PRIOR ART
Figure 11:
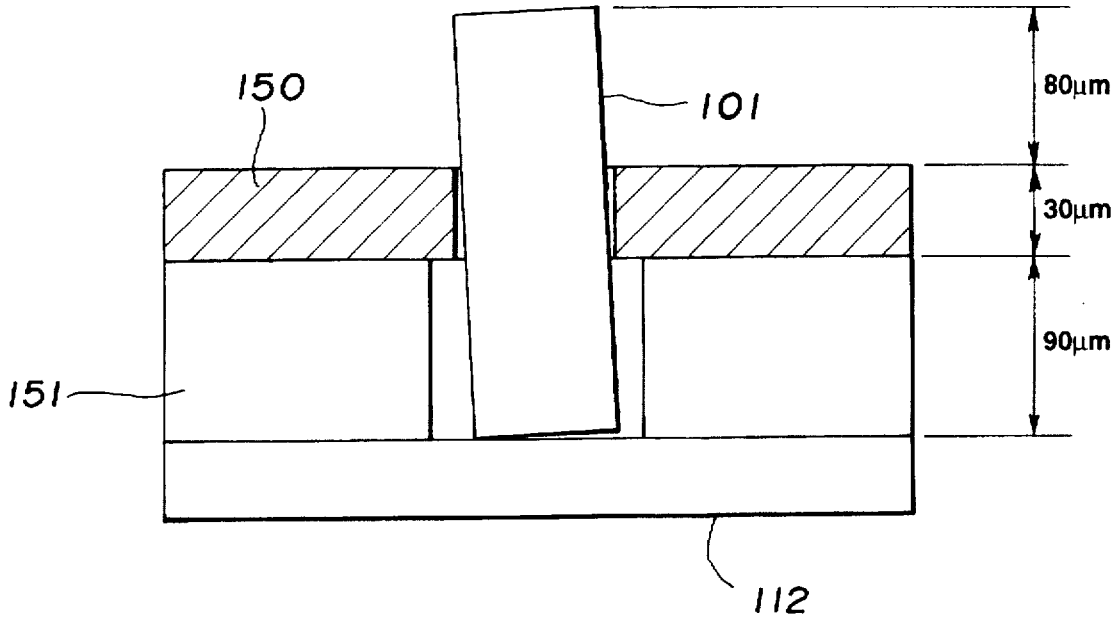
FIG. 11 is a schematic view showing another conventional aligning plate.

Referring first to FIG. 1, an aligning plate incorporated in an embodiment of a support aligning fixture according to the present invention is illustrated, wherein supports are kept arranged in an aligning plate. A support aligning fixture of the illustrated embodiment is adapted to be used for a vacuum glass envelope for a fluorescent display device, which envelope includes a first glass substrate and a second glass substrate which may be arranged so as to be spaced from each other while being opposite to each other in a manner similar to FIG. 7. In FIG. 1, reference numeral 1 designates supports arranged between the first glass substrate and the second glass substrate in a manner to be spaced from each other at predetermined intervals, to thereby keep the first and second glass substrates spaced from each other at a predetermined interval. Reference numeral 2 designates an aligning plate including a first aligning plate member 2*a* of a shape like a thin plate and a second aligning plate member 2b of a shape like a thin plate. The first aligning plate member 2a corresponds to the aligning plate 111 for the support aligning fixture 110 shown in FIG. 8 and the second aligning plate member 2b is constructed in substantially the same manner as the first aligning plate member 2a and arranged under the first aligning plate member 2a while being registered or aligned with the aligning plate member 2a. Reference numeral 10 is a number of support holes formed through the first and second aligning plate members 2a and 2b and fitted therein with the supports 1. The first and second aligning plate members 2a and 2b cooperate with each other to construct the aligning plate 2 into a two-layer structure. Reference numeral 112 is a perforated section on which the aligning plate 2 is arranged.

The vacuum glass envelope constructed of the first and second glass substrates arranged opposite to each other with a predetermined interval being defined is provided on a periphery thereof with a seal section such as a spacer or the like.

In the illustrated embodiment, as described above, the first aligning plate member 2a and second aligning plate member 2b are superposed or laminated on each other while being registered with each other, to thereby provide the aligning plate 2. The first and second aligning plate members 2a and 2b each are formed into a thickness of about 60 μm and may be made according to the procedure described above with reference to FIGS. 10(*a*) to 10(*d*). This permits the support holes 10 of the first and second aligning plate members 2a and 2b to be formed with increased accuracy while being tapered. The first and second aligning plate members 2a and 2b are laminated or superposed on each other in such a manner that surfaces of the aligning plate members 2a and 2b on which the support holes 10 are increased in diameter face each other.

The support holes 10 of each of the first and second aligning plate members 2a and 2b each are downwardly tapered so that an upper end thereof through which the support 1 is fitted therein is enlarged into a diameter of about 60 μm. This results in a gap between the support hole 10 and the support 1 of 50 μm in average diameter being as large as about 10 μm, to thereby facilitate fitting of the support 1 in the support hole 10.

Also, the support holes 10 each are tapered so that a lower end thereof which functions to position the support 1 fitted in the support hole 10 has a diameter of about 53 μm. The first and second aligning plate members 2a and 2b like a thin plate shape which permit the support holes 10 to be formed with increased accuracy are thus superposed on each other, so that each of the supports 1 may be positioned by the two diameter-reduced lower ends of the support holes 10 of the first and second aligning plate members 2a and 2b aligned or registered with each other, resulting in positional accuracy of the support 1 or accuracy with which the support 1 is arranged in the support holes 10 being increased.

Thus, the first embodiment shown in FIG. 1 permits displacement of the support in the support hole 10 to be regulated by the two diameter-reduced portions of the support holes 10 of the first and second aligning plate members 2a and 2b formed with increased accuracy and aligned with each other. Thus, accuracy with which the support holes 10 are formed while being tapered is permitted to have increased tolerance, so that etching as well as electroplating may be applied to the first and second aligning plate members 2a and 2b, leading to a decrease in manufacturing cost of the fixture.

Also, the first and second aligning plate members 2a and 2b are constructed into the same construction or configuration, to thereby be manufactured by the same mask, resulting in the manufacturing being simplified and further reduced in cost.

Further, in the illustrated embodiment, the aligning plate 2 is formed by laminating the first and second aligning plate members 2a and 2b on each other, to thereby be increased in whole thickness, resulting in reducing projection of the supports 1 from the aligning plate 2, so that displacement of the supports 1 may be further decreased. For example, when the first and second aligning plate members 2a and 2b are formed into a thickness of about 60 μm and the supports 1 each are formed into a diameter of about 50 μm and a length of about 200 μm, the amount of projection of the supports 1 from the aligning plate 2 is reduced to a level as small as about 80 μm, so that the illustrated embodiment may substantially reduce the displacement or deviation as compared with the prior art.

In the illustrated embodiment, superposition of the first and second aligning plate member 2a and 2b is carried out while being registered or aligned with each other. The registration between the plate members 2a and 2b may be carried out using an equipment including parallel suction surfaces and a microscope for registration or alignment. Then, both aligning plate members 2a and 2b are fixedly joined to each other by adhesion, spot welding or the like. The joining may be carried out with accuracy within 5 μm.

Figure 2:
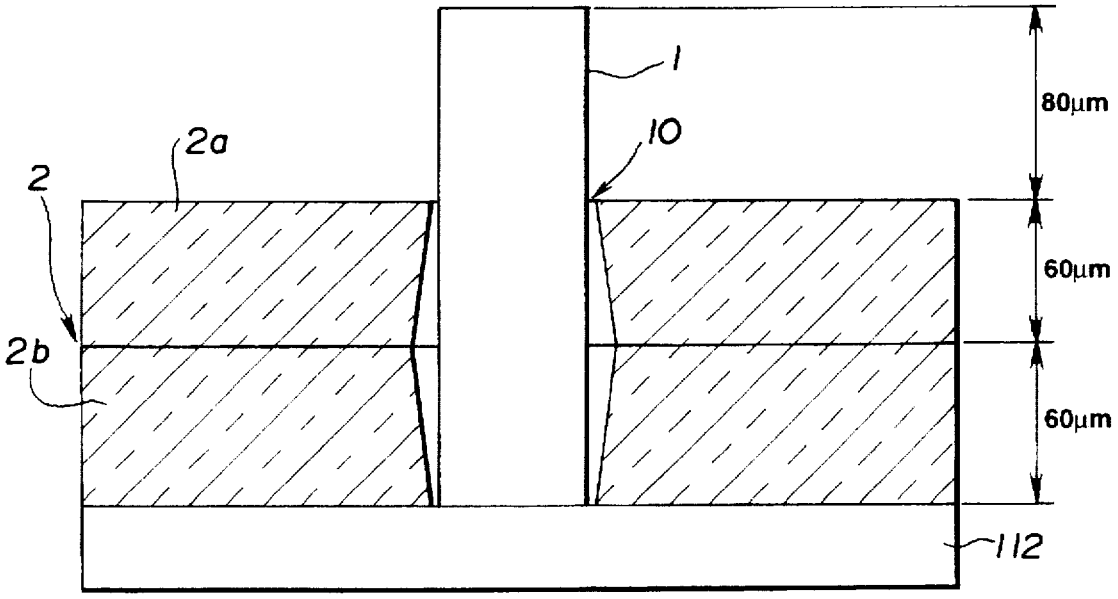
FIG. 2 is a schematic view showing an aligning plate incorporated in another embodiment of a support aligning fixture according to the present invention.

Referring now to FIG. 2, another or a second embodiment of a support aligning fixture according to the present invention is illustrated. In a support aligning fixture of the illustrated embodiment, first and second aligning plate members 2a and 2b are superposed on each other in such a manner that surfaces of the aligning plate members on which tapered support holes 10 are increased in diameter face each other. The remaining part of the second embodiment may be constructed in substantially the same manner as the first embodiment described above.

In the support aligning fixture of the illustrated or second embodiment thus constructed, when the supports 1 each are fitted in the support holes 10 of the first and second aligning plate members 2a and 2b, the support 1 is positioned in the support holes 10 of the first and second aligning plate members 2a and 2b by cooperation between a diameter-reduced upper end of the tapered support hole 10 of the first aligning plate member 2a formed with increased accuracy and a diameter-reduced lower end of the tapered support hole 10 of the second aligning plate member 2b likewise formed with increased accuracy. Thus, the support 1 is positioned by the two diameter-reduced ends of the plate members 2a and 2b increased in accuracy, resulting in positional accuracy of the support 1 being highly improved.

Thus, the illustrated embodiment likewise permits displacement or deviation of the support 1 in the support holes 10 of the first and second aligning plate members 2a and 2b to be regulated by the diameter-reduced end of the support hole 10 of each of the plate members 2a and 2b, so that accuracy with which each of the support holes 10 is formed while being tapered is permitted to have increased tolerance, so that etching as well as electroplating may be applied to processing of the aligning plate members 2a and 2b, leading to a decrease in manufacturing cost of the fixture.

Also, the first and second aligning plate members 2a and 2b are constructed into the same structure or configuration, to thereby be manufactured by the same mask, resulting in manufacturing of the fixture being simplified and reduced in cost.

Further, in the illustrated embodiment as well, the aligning plate 2 is formed by laminating the first and second aligning plate members 2*a* and 2*b*, to thereby be increased in whole thickness, resulting in the amount of projection of the supports 1 from the aligning plate 2 being decreased, so that displacement or deviation of the supports 1 from a central axis of the support holes may be further reduced. For example, when the first and second aligning plate members 2*a* and 2*b* are formed into a thickness of about 60 μm and the supports 1 each are formed into a diameter of about 50 μm and a length of about 200 μm, the amount of projection of the supports 1 from the aligning plate 2 is reduced to a level as small as about 80 μm, which is highly reduced as compared with that in the prior art.

Figure 3:
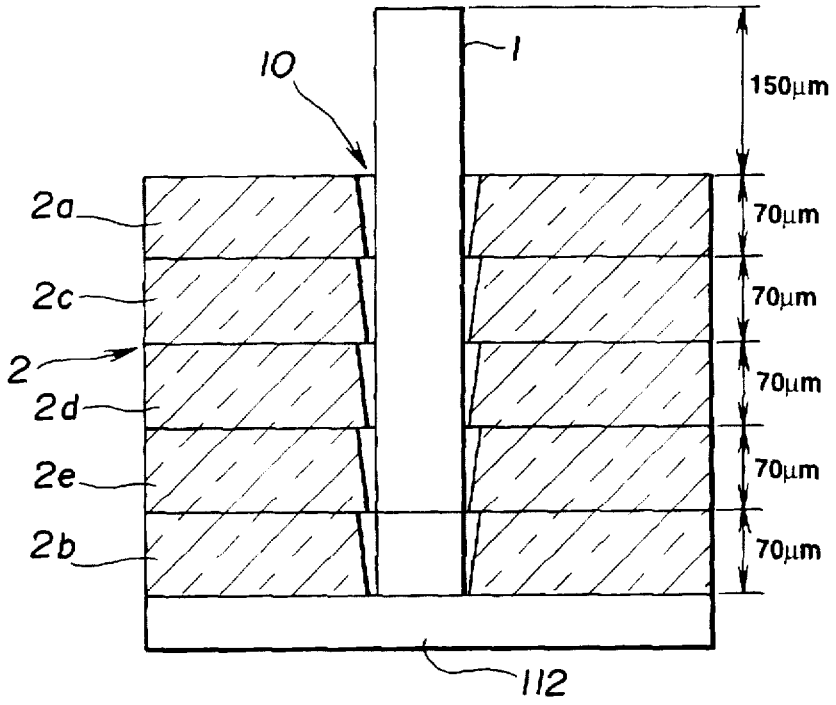
FIG. 3 is a schematic view showing an aligning plate incorporated in a further embodiment of a support aligning fixture according to the present invention.

Referring now to FIG. 3, a further or third embodiment of a support aligning fixture according to the present invention is illustrated, wherein supports are kept fitted in support holes of a support aligning plate. In a support aligning fixture of the third embodiment, first or uppermost and second or lowermost aligning plate members 2*a* and 2*b* and third to fifth or intermediate aligning plate members 2*c* to 2*e* are superposed on each other in order in a manner like that shown in FIG. 1, to thereby provide an aligning plate 2. The aligning plate members 2*a* to 2*e* are constructed in the same manner. The remaining part of the third embodiment may be constructed in substantially the same manner as the first embodiment described above with reference to FIG. 1.

In the support aligning fixture of the illustrated embodiment thus constructed, when the supports 1 each are fitted in the support holes 10 of the first to fifth aligning plate members 2*a* to 2*e* , the support 1 is positioned in the support holes 10 of the first to fifth aligning plate members 2*a* to 2*e* by cooperation among a diameter-reduced lower end of the tapered support hole 10 of the first aligning plate member 2*a* formed with increased accuracy to that of the tapered support hole 10 of the second aligning plate member 2*b* likewise formed with increased accuracy. Thus, the support 1 is positioned by the five diameter-reduced lower ends of the plate members 2*a* to 2*e* increased in accuracy, resulting in positional accuracy of the support 1 being highly improved.

Also, in the illustrated embodiment as well as the above-described embodiments, the aligning plate 2 is formed by laminating the first to fifth aligning plate members 2*a* to 2*e* on each other, to thereby be increased in whole thickness thereof. Thus, arrangement of the supports 1 in the support holes 10 may be accomplished with increased accuracy even when a ratio of a length of the supports 1 to a diameter thereof is increased. For example, when the first to fifth aligning plate members 2*a* to 2*e* each are formed into a thickness of about 70 μm and the supports 1 each are formed into a diameter of about 50 μm and a length of about 500 μm, the amount of projection of the supports 1 from the aligning plate 2 is reduced to a level as small as about 150 μm, which corresponds to about one fourth as large as the whole length. Thus, it will be noted that the illustrated embodiment substantially reduces displacement of the supports 1 in the aligning plate 2 irrespective of an increase in ratio of a length of the supports 1 to a diameter thereof. This permits intervals between gates and anodes in a fluorescent display device to be significantly increased, leading to an increase in anode voltage, resulting in luminous efficiency of a phosphor being improved.

The dimensions of the aligning plate members 2*a* to 2*e* are merely illustrative, therefore, the present invention is never limited thereto.

Thus, the third embodiment shown in FIG. 3 likewise permits displacement or deviation of the support 1 in the support holes 10 of the first to fifth aligning plate members 2*a* to 2*e* to be regulated by the diameter-reduced end of the support hole 10 of each of the plate members 2*a* to 2*e*, so that accuracy with which each of the support holes 10 is formed while being tapered is permitted to have tolerance increased. Therefore, etching as well as electroplating may be effectively applied to processing of the aligning plate members 2*a* to 2*e*, leading to a decrease in manufacturing cost of the fixture.

Also, the first to fifth aligning plate members 2*a* to 2*e* are constructed into the same structure or configuration, to thereby be manufactured by the same mask, resulting in manufacturing of the fixture being simplified and reduced in cost.

Figure 4:
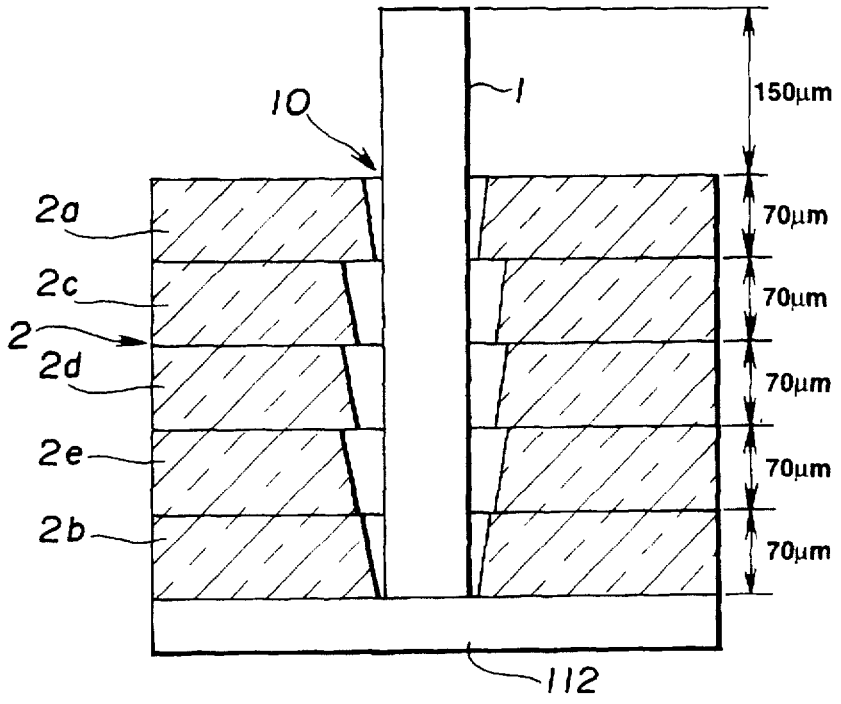
FIG. 4 is a schematic view showing a modification of the aligning plate shown in FIG. 3.

Referring now to FIG. 4, a modification of the embodiment shown in FIG. 3 is illustrated, wherein supports are fitted in an aligning plate. In a support aligning fixture of the modification, support holes 10 of each of third to fifth intermediate aligning plate members 2*c* to 2*e* interposed between a first or uppermost aligning plate member 2*a* and a second or lowermost aligning plate member 2*b* are formed into a diameter larger than those of each of the first and second aligning plate members 2*a* and 2*b*. Such construction of the modification facilitates aligning of the third to fifth aligning plate members 2*c* to 2*e* and permits accuracy with which the support holes 10 of the plate members 2*c* to 2*e* are tapered to be reduced to a degree, resulting in manufacturing of the fixture being facilitated. The remaining part of the modification may be constructed in substantially the same manner as the embodiment described above with reference to FIG. 3.

In the support aligning fixture of the modification thus constructed, when the supports 1 each are fitted in the support holes 10 of the first to fifth aligning plate members 2*a* to 2*e* , the support 1 is positioned in the support holes 10 of the first to fifth aligning plate members 2*a* to 2*e* by cooperation between a diameter-reduced lower end of the tapered support hole 10 of the first or uppermost aligning plate member 2*a* formed with increased accuracy and that of the tapered support hole 10 of the second or lowermost aligning plate member 2*b* likewise formed with increased accuracy, resulting in positional accuracy of the support 1 being highly improved.

Also, in the modification as well as the embodiment of FIG. 3, the aligning plate 2 is formed by laminating the first to fifth aligning plate members 2*a* to 2*e*, to thereby be increased in whole thickness. Thus, arrangement of the supports 1 in the support holes 10 may be accomplished with increased accuracy even when a ratio of a length of the supports 1 to a diameter thereof is increased. For example, when the first to fifth aligning plate members 2*a* to 2*e* each are formed into a thickness of about 70 μm and the supports 1 each are formed into a diameter of about 50 μm and a length of about 500 μm, the amount of projection of the supports 1 from the aligning plate 2 is reduced to a level as small as about 150 μm, which corresponds to about one fourth as large as the whole length. Thus, it will be noted that the modification substantially reduces displacement of the supports 1 irrespective of an increase in ratio of a length of the supports 1 to a diameter thereof. This permits intervals between gates and anodes in a fluorescent display device to be significantly increased, leading to an increase in anode voltage, resulting in luminous efficiency of a phosphor being improved.

Figure 5:
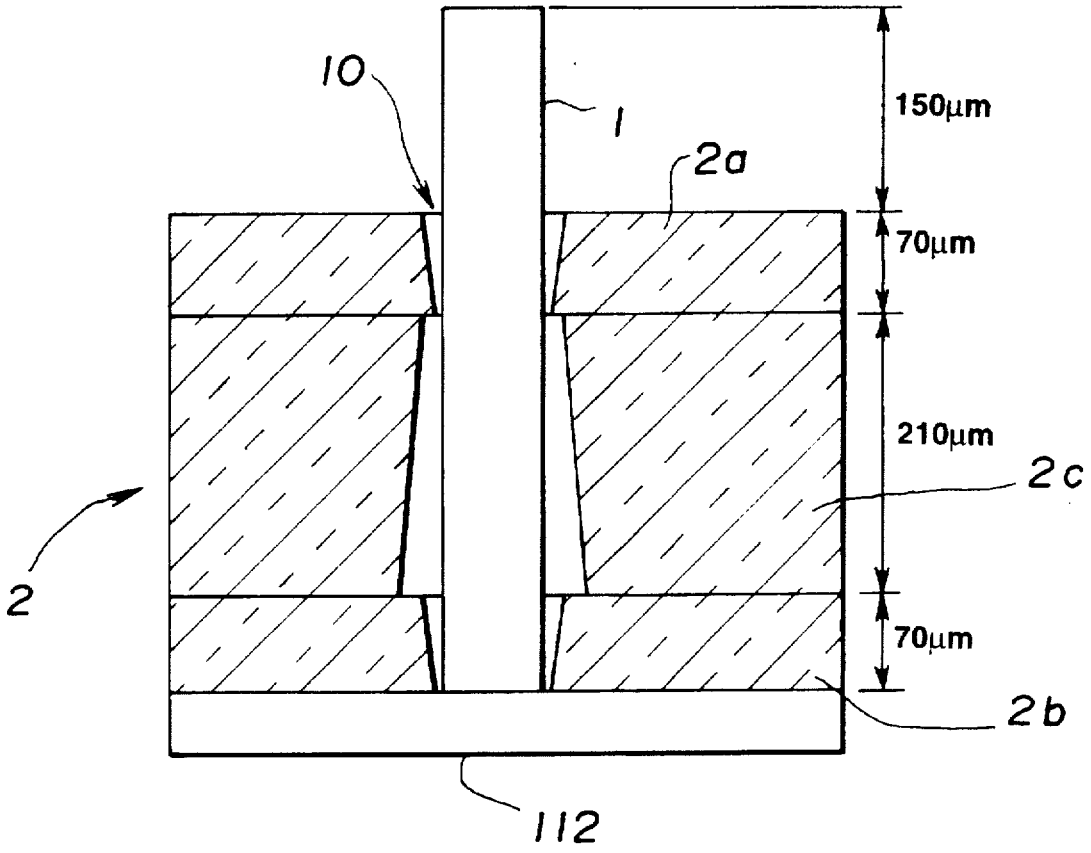
FIG. 5 is a schematic view showing an aligning plate incorporated in still another embodiment of a support aligning fixture according to the present invention.
Figure 6:
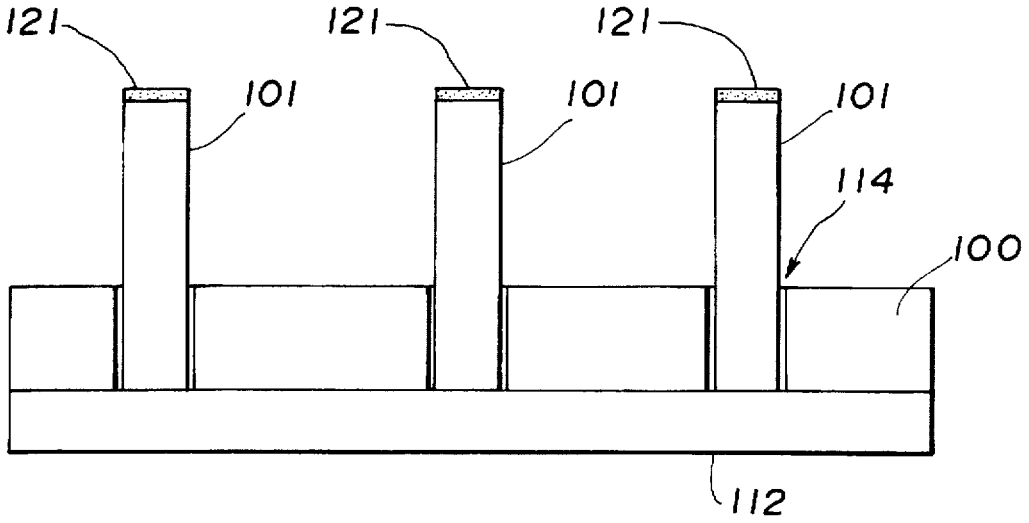
FIG.6 PRIOR ART
FIG. 6 is a schematic view showing a manner of arrangement of supports by means of a conventional aligning plate.

Referring now to FIG. 5, a still further or fourth embodiment of a support aligning fixture according to the present invention is illustrated, wherein supports are likewise kept fitted in support holes of a support aligning plate. In a support aligning fixture of the fourth embodiment, an aligning plate 2 includes an upper aligning plate member 2*a* and a lower aligning plate member 2*b* formed into a shape like a thin plate, as well as an intermediate aligning plate member 2*c* formed into a thickness larger than the plate members 2*a* and 2*b* and sandwiched or interposed between both plate members 2*a* and 2*b*, resulting in being constructed into a three-layer structure. Also, support holes 10 of the intermediate aligning plate member 2*c* are formed into a diameter larger than those of the plate members 2*a* and 2*b*. Also, the intermediate plate member 2*c* is so arranged that a direction of tapering of the support holes 10 thereof is opposite to that of both outer plate members 2*a* and 2*b*. Supports 1 each are positioned by a lower end of the support hole 10 of the first or upper aligning plate member 2*a* and a lower end of the support hole 10 of the second or lower aligning plate member 2*b*.

In the fourth embodiment, the aligning plate 2 is formed by superposing three aligning plate members 2*a* to 2*c* while being aligned with each other, so that the supports, even when they are increased in ratio of a length to a diameter, are arranged in the support holes 10 with increased accuracy. Also, the illustrated embodiment permits accuracy of the support holes 2 of the intermediate aligning plate member 2*c* to be significantly reduced, to thereby increase a thickness of the aligning plate member 2*c*, resulting in facilitating manufacturing of the fixture.

Also, the fourth embodiment permits each of the supports 1 arranged in the support holes 10 to be positioned by a diameter-reduced lower end of each of the support holes 10 of the upper and lower aligning plate members 2*a* and 2*b*, resulting in positional accuracy of the supports 1 being enhanced.

For example, when the first and second or outer aligning plate members 2*a* and 2*b* and the third or intermediate aligning plate member 2*c* are formed into a thickness of about 60 μm and about 210 μm, respectively, and the supports 1 each are formed into a diameter of about 50 μm and a length of about 500 μm; the amount of projection of the supports 1 from the aligning plate 2 is reduced to a level as small as about 150 μm, which corresponds to about one fourth as large as a whole length of the supports 1. Thus, the illustrated embodiment substantially reduces displacement of the supports 1 in the support holes 10 irrespective of an increase in ratio of a length of the supports 1 to a diameter thereof. This permits intervals between gates and anodes in a fluorescent display device to be significantly increased, leading to an increase in anode voltage, resulting in luminous efficiency of a phosphor being improved.

The number of aligning plate members and dimensions thereof are not limited to those specified in the embodiments described above. Also, in the drawings, one to a few support holes are illustrated for the sake of brevity. However, actually, a number of such support holes 10 are provided in the aligning plate 2.

As can be seen from the foregoing, the present invention is so constructed that at least two aligning plate members of a shape like a thin plate which are formed into the same thickness are superposed on each other directly or indirectly while being aligned or registered with each other. Such construction permits a whole thickness of the aligning plate to be increased. Also, the support holes are tapered, to thereby facilitate arrangement of the supports in the support holes. Further, formation of the aligning plate by superposition of the aligning plate members permits supporting of the supports in the aligning plate to be carried out at a high position in the aligning plate and a whole thickness of the aligning plate to be increased, resulting in positional accuracy of the supports being improved.

In addition, the superposition permits ensures increased positional accuracy of the supports even when a ratio of a length of the supports to a diameter thereof is increased. This permits a length of the supports to be increased to 500 μm or more, leading to an increase in anode voltage, resulting in luminous efficiency of a phosphor being improved.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A support aligning fixture which is directed to a vacuum glass envelope at least including two glass substrates arranged opposite to each other and functions to hold supports between the glass substrates of the vacuum glass envelope to keep the glass substrates spaced from each other at a predetermined microinterval, comprising:

at least two aligning plate members like a thin plate each formed with a plurality of support holes in which the supports are raisedly arranged;

at least upper and lower ones of said aligning plate members being formed into the same thickness and superposed on each other while being registered with each other to provide an aligning plate.

2. A support aligning fixture as defined in claim 1, wherein said support holes each are formed into a tapered shape in section;

said aligning plate members for said aligning plate being superposed on each other in such a manner that surfaces of said aligning plate members on which said support holes are increased in diameter face each other.

3. A support aligning fixture as defined in claim 1, wherein said support holes of at least one intermediate one of said aligning plate members are formed into a larger diameter than those of said upper and lower ones of said aligning plate members.

4. A support aligning fixture which is directed to a vacuum glass envelope at least including two glass substrates arranged opposite to each other and functions to hold supports between the two glass substrates of the vacuum glass envelope to keep the glass substrates spaced from each other at a predetermined microinterval, comprising:

two first aligning plate members like a thin plate each formed with a plurality of support holes in which the supports are raisedly arranged;

said first aligning plate members being formed into the same thickness and superposed on each other while being registered with each other; and at least one second aligning plate member formed into a thickness different from said first aligning plate members and provided with a plurality of support holes;

said second aligning plate member being interposedly arranged between said two first aligning plate members while being registered with said first aligning plate members;

said first and second aligning plate members cooperating with each other to provide an aligning plate;

said support holes of said second aligning plate member being formed into a diameter larger than those of said first aligning plate members.

5. A support aligning fixture as defined in claim 4, wherein said support holes each are formed into a tapered shape in section; and said first and second aligning plate members are superposed on each other in turn in such a manner that surfaces of said first aligning plate members on which said support holes thereof are increased in diameter face up and a surface of said second aligning plate member on which said support holes thereof are increased in diameter faces down.

* * * * *